US006085373A

United States Patent [19]

Montana

[11] Patent Number: 6,085,373

[45] Date of Patent: Jul. 11, 2000

[54] MODULAR MATTRESS WITH GRADUALLY VARYING HEIGHTS TOWARD THE CENTER, HAVING DIFFERENT RIGIDITIES AND ELASTIC RESPONSES

[76] Inventor: Vittorio Montana, Via Gran San Bernardo, 15, 20154 Milan, Italy

[21] Appl. No.: 09/320,665

[22] Filed: May 27, 1999

[30] Foreign Application Priority Data

Jun. 5, 1998 [IT] Italy ..... BO98A0365

[51] Int. Cl.[7] ..... A47C 27/15

[52] U.S. Cl. ..... 5/727; 5/722; 5/723; 5/731

[58] Field of Search ..... 5/727, 731, 722, 5/723, 740, 690

[56] References Cited

U.S. PATENT DOCUMENTS

| | | | |
|---|---|---|---|
| 2,229,536 | 1/1941 | Wilkich | 5/731 |
| 3,047,888 | 8/1962 | Shecter | 5/740 |
| 3,210,781 | 10/1965 | Pollock | 5/727 |
| 3,608,106 | 9/1971 | Parramon | 5/731 |
| 4,053,957 | 10/1977 | Regan | 5/727 |
| 4,526,830 | 7/1985 | Ferziger et al. | 5/483 |
| 5,669,094 | 9/1997 | Swanson | 5/740 |
| 5,671,492 | 9/1997 | Simon | 5/722 |

FOREIGN PATENT DOCUMENTS

| | | | |
|---|---|---|---|
| 0777988 | 6/1997 | European Pat. Off. . | |
| 921408 | 12/1954 | Germany | 5/723 |
| 4229401 | 3/1994 | Germany . | |
| 29711812 | 9/1997 | Germany . | |
| 19623014 | 12/1997 | Germany . | |

*Primary Examiner*—Alexander Grosz
*Attorney, Agent, or Firm*—Guido Modiano; Albert Josif; Daniel O'Byrne

[57] ABSTRACT

A mattress made of foamed plastic material with modulated rigidity, having an upper layer made of a plastic material with a composition based on an open cell polyurethanic foam with silicone, flameproofing, fungicide and bacteriostatic additives, having low elastic memory and being substantially inelastic, which is arranged on a lower layer which is composed of modular elements which are mutually assembled by joints of the mortise and tenon types.

6 Claims, 1 Drawing Sheet

MODULAR MATTRESS WITH GRADUALLY VARYING HEIGHTS TOWARD THE CENTER, HAVING DIFFERENT RIGIDITIES AND ELASTIC RESPONSES

BACKGROUND OF THE INVENTION

The present invention relates to a modular mattress with gradually varying heights toward the center and made of flexible foamed plastic material in superimposed layers having a rigidity, or rather a load-bearing capacity (the ability to support a load by withstanding its weight), which is differentiated in the horizontal component of the mattress and an elastic response, or rather resilience (ability to return mechanical stresses in terms of elastic thrust and rebound), which is differentiated and opposite in the vertical component, i.e., having high elasticity in the base layer and being substantially inelastic in the surface layer.

It is generally acknowledged that in order to avoid damage to the spine, the onset of postural problems and disorders of sleep neurophysiology and therefore ensure the maximum benefit of resting for all the period spent on the mattress, said mattress must allow a physiological and natural position of the body, respecting its anatomy and biological functions with a behaviour which is indeed anatomical and functional.

Accordingly, it is the mattress that must adapt to our body and respect it, not the opposite; however, people have different body types and shapes, whereas it is likely that the same mattress must effectively cope with different anatomical, weight and functional stresses.

In order to achieve these results, mattresses have been proposed which give the body a generic support expressed in terms of an elastic response to the weights that affect the surface, which is unevenly distributed only on a discrete number of points, preventing the spine from maintaining its natural shape, regardless of one's position during sleep, and most of all neglecting and preventing important biological functions which are indispensable for maintaining sleep and the quality of rest, such as:

- maintaining the blood flow in the capillaries of surface tissues;
- lymphatic and venous drainage of the lower limbs;
- pulmonary ventilation;
- cardiac activity;
- noncompressive compliance on joints and muscles;
- maintaining the position assumed in sleep for prolonged times.

SUMMARY OF THE INVENTION

The aim of the present invention is to provide a mattress which allows anyone, regardless of his/her anatomy, weight and physical functional condition of course within the limits of extreme pathological conditions), to achieve a physiological posture which is ideal for the quality of sleep and for the well-being of the body.

This aim is achieved by a modular mattress made of flexible foamed plastic material in superimposed layers and with horizontally differentiated load-bearing capacity, vertically opposite elasticity and an architecture with heights which gradually vary from the head and foot edges toward the center of the item.

The mattress, according to the invention, comprises a base layer with containment edges which is composed of two elastic peripheral modules which have a lower rigidity or load-bearing capacity than the central module (where the greatest weight bears), which is also elastic but has a higher rigidity or load-bearing capacity; the modules of said first layer are kept together by joints of the mortise and tenon type; the upper surface layer, contained in said base structure, is made of a special foamed plastic polymer which can be thermoformed under pressure, characterized in that it has a very high formability and indentability arising from a substantial lack of resilience, i.e., of elastic response to mechanical stresses (no appreciable resilience according to UNI6357 standards), preferably of the type known commercially under the trademark Synergel in the name of the Applicant.

In this invention, therefore, the base structure is meant to follow elastically the mechanical deformations and to offer a harmonic and differentiated support to the body as a function of the weight applied; the upper layer of Synergel, by shaping itself on the anatomy of the body, allowing parceling and millimetric distribution of the applied weight over the entire contact surface; furthermore, the inelastic behavior, due to low resilience (i.e. not high enough to be measurable according to the UNI6357 standard), allows an essential cushioning of the compressive elastic return thrusts on the tissues of the body.

The symbiosis between a base layer that appropriately supports the different parts of the body with an elastic action and the upper layer of Synergel (which absorbs, distributes and disperses the weight applied by the body, whose anatomy is also followed by an inelastic and form-fitting action), associated with a particular architecture with heights which gradually vary toward the center, allows the body to assume a position which is adapted to maintain and facilitate said biological functions.

As a whole, the invention offers an innovative sum of features which is meant to increase the quality of rest even in case of tiredness due to sports and/or work, joint and muscle inflammations, impaired cardiac and pulmonary activity, disorders arising from lymphatic and arteriovenous stasis in the lower limbs, gastroesophageal reflux, pregnancy, excessive skinniness, disorders arising from long confinements to bed etcetera.

Furthermore, an object of the present invention is to provide a mattress which is structured so that it can be disassembled in order to allow easy handling during manufacture and transport and when the mattress is to be cleaned or sanitized.

BRIEF DESCRIPTION OF THE DRAWINGS

Further characteristics and advantages will become apparent from the following detailed description of the present invention illustrated only by way of non-limitative example in the accompanying drawing, wherein.

DESCRIPTION OF THE PREFERRED EMBODIMENTS

Figure 1:
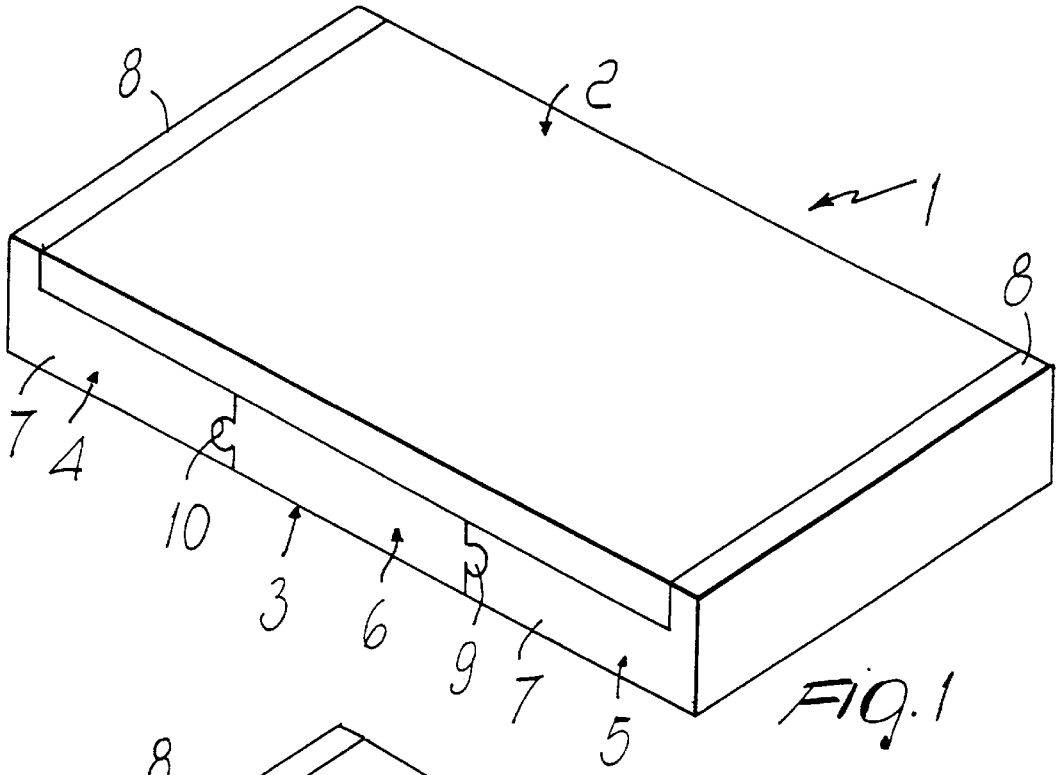
FIG. 1 is a perspective view of the mattress according to a first embodiment.

With reference to the figures, the mattress is generally designated by the reference numeral 1 and comprises an upper layer 2 which rests on a lower layer 3 without applying adhesives or the like.

The upper layer is made of a foamed plastics which is commercially classified as having a substantially null resilience (i.e. so low that it cannot be measured according to UNI 6357). A main feature of such a material is that if a hard body, say a metallic sphere, is sunk by pressure therein, once the body is released, it does not bounce back as it would occur for an elastic/resilient material, but it is only slowly and gradually lifted to the initial level.

Preferably, said material is a polyurethane-based copolymer known commercially as Synergel and marketed by the Applicant. The material "Synergel" is substantially an open cell polyurethanic foam copolymer based composition comprising: 50% of polyester polyol, 12% polyether polyol, 20% toluene diisocyanate (TDI), 1% water, 1% catalysts, and 16% silicone, flameproofing, fungicide and bacteriostatic additives.

The lower layer 3 is composed of a plurality of modular elements, for example three elements 4, 5, 6 made of foamed plastics; the elements 4 and 5 constitute the end elements and the element 6 is the intermediate one.

The end elements 4 and 5 are L-shaped and comprise a base 7 from one side of which there rises a wall 8 whose height is equal to the height of the upper layer.

The end elements 4 and 5 are connected to the intermediate element 6 by transverse joints of the mortise and tenon type. In particular, the transverse element has, along its opposite transverse edges, respective tenons 9 having a circular cross-section which are adapted to engage respective slots or mortises which have a complementary cross-section and are formed along the transverse sides of the bases 7 of the elements 4 and 5.

The tenons 9 and the mortises 10 can of course have any cross-section, for example a dovetail or T-like one, so long as it ensures a sufficiently strong engagement of the elements 4 and 5 with the element 6.

A substantial prerogative of the present invention is the fact that the elements 4, 5 and 6 have differentiated rigidities. In particular, the end elements 4 and 5 have a higher elastic constant than the intermediate element 6 and a lower density and/or load-bearing ability.

For example, the elements 4 and 5 can be made of foamed polyurethane having a density between 20 and 40 kg/m$^3$, preferably a density equal to 30 kg/m$^3$ and a load-bearing capacity of 3.3 KPa+/−15% (40% compression according to UNI 6351), while the intermediate element 6 is made of a foamed polyurethane having a density between 20 and 70 kg/m$^3$, preferably a density equal to 40 kg/m$^3$ and a load-bearing capacity of 5.2 KPa+/−15% (40% compression according to UNI 6351), so long as the density and/or load-bearing capacity of the intermediate element is always higher than that of the end elements.

The above-described mattress, by the combination of the two layers having opposite resilience and of the difference in density and/or load-bearing capacity among the elements 4, 5 and 6, allows to obtain, in the regions subjected to higher loads, elastic reactions which are proportional to the weight that affects them. In particular, the lower layer 3 (4, 5, 6) determines elastic reactions for providing harmonic support at the different parts of the body which reactions, synergistically with the upper layer made of Synergel, reduce the compression of skin tissues that cover protrusions of the bone, of the musculoskeletal system in general and of the capillary vessel system, and accordingly increase the feeling of well-being, allow a physiologically correct posture and ensure a sound sleep, without detrimental interruptions, and consequent physical recovery.

Figure 2:
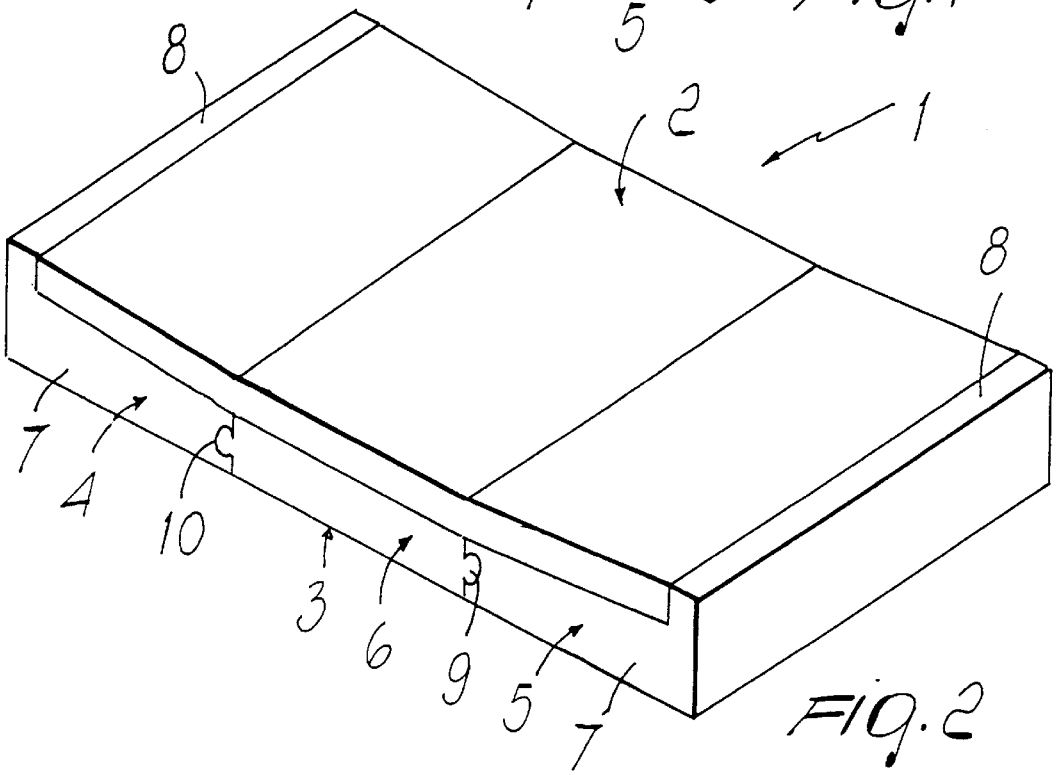
FIG. 2 is a perspective view of the mattress according to another embodiment.

The above-described mattress is susceptible of numerous modifications and variations, all of which are within the scope of the same inventive concept. For example, in the embodiment, shown in FIG. 2, the upper layer of Synergel has a slight recess in the central region, so that the mattress has a surface which rises at the opposite ends and causes the user's upper trunk and lower limbs to be physiologically raised with respect to the central part. This arrangement has beneficial effects on anyone, but most of all on individuals suffering from cardiac and respiratory distress and helps to fight swelling and heaviness in the lower limbs.

Preferably, the concave shape of the mattress is achieved by giving a wedge-like shape to the bases of the end elements (also termed modules) or with a degrading cut of the Synergel layer from the ends toward the center thereof.

In the practical embodiment of the invention, the number of elements that compose the lower layer can be any according to requirements.

The disclosures in Italian Patent Application No. BO98A000365 from which this application claims priority are incorporated herein by reference.

What is claimed is:

1. A mattress made of foamed plastics with modulated rigidity, comprising: an upper layer of plastic material with a composition comprised of an open cell polyurethanic foam with silicone, flameproofing, fungicide and bacteriostatic additives, having low elastic memory and being substantially inelastic with a substantially null resilience; and a lower layer for supporting said upper layer, said lower layer being composed by a plurality of modular elements which are mutually assembled mortise and tenon joints, said lower layer being composed of three modular elements made of foamed plastic material, said modular elements comprising two end elements and an intermediate element, said end elements being L-shaped and having each a respective base from one side of which a wall projects which is as high as said upper layer, said end elements being connected to the intermediate element by said mortise and tenon joints, said end elements being made of foamed polyurethane having a density between 20 and 40 kg/m$^3$, and a load-bearing capacity of 3.3+/−15% KPa (40% compression according to UNI 6351), and said intermediate element is made of a foamed polyurethane which has a density between 20and 70 kg/m$^3$, and a load-bearing capacity of 5.2+/−15% KPa (40% compression according to UNI 6351), at least one between the density and load-bearing capacity of the intermediate element being always higher than that of the end elements.

2. The mattress of claim 1, wherein said intermediate element comprises, along opposite transverse edges thereof, respective tenons, and said end elements comprise along transverse sides of said base respective mortises having a cross-section which is complementary to that of said tenons, said tenons engaging in said mortises.

3. The mattress of claim 2, wherein said tenons and mortises have any of a circular, dovetail and T-shaped cross-section.

4. The mattress of claim 2, wherein said upper layer has, in longitudinal cross section, any of a slight recess in a central region thereof and a slightly concave shape.

5. The mattress of claim 4, wherein said central recess or slightly concave shape of said upper layer is obtained by shaping said respective bases of the end elements in a wedge-like manner.

6. The mattress of claim 1, wherein said end elements have a density equal to 30 kg/m$^3$, and said intermediate element has a density equal to 40 kg/m$^3$.

* * * * *